US005667122A

United States Patent [19]

Young, Jr. et al.

[11] Patent Number: 5,667,122

[45] Date of Patent: Sep. 16, 1997

[54] APPARATUS AND METHOD FOR CONTROLLING MOVING MATERIAL AND THE LIKE

[75] Inventors: William O. Young, Jr.; Michael R. Bell; George Lark, all of Spartanburg, S.C.

[73] Assignee: Young Engineering, Inc., Spartanburg, S.C.

[21] Appl. No.: 551,876

[22] Filed: Oct. 16, 1995

[51] Int. Cl.[6] ..... B65H 43/08; B23Q 15/00; D06C 3/02

[52] U.S. Cl. ..... 226/20; 26/76; 226/1; 226/45; 226/53

[58] Field of Search ..... 226/1, 3, 15, 19, 226/20, 45, 53; 26/75, 76

[56] References Cited

U.S. PATENT DOCUMENTS

| | | | |
|---|---|---|---|
| 12,771 | 4/1855 | Hawes . | |
| 88,505 | 3/1869 | Palmer . | |
| 459,203 | 9/1891 | Hollingworth . | |
| 1,697,828 | 1/1929 | Cunniff . | |
| 1,773,232 | 8/1930 | Lenders . | |
| 1,880,487 | 10/1932 | Richardson . | |
| 2,402,074 | 6/1946 | Nield . | |
| 2,907,195 | 10/1959 | Schoenster et al. . | |
| 2,916,899 | 12/1959 | Hepp et al. . | |
| 3,031,732 | 5/1962 | Carlisle . | |
| 3,096,919 | 7/1963 | Snyder | 226/3 |
| 3,108,727 | 10/1963 | Farber | 226/45 X |
| 3,160,340 | 12/1964 | Menkel | 226/53 |
| 3,244,418 | 4/1966 | Henderson | 226/19 X |
| 3,366,876 | 1/1968 | Kurth et al. . | |
| 3,568,904 | 3/1971 | Kurz | 226/15 |
| 3,752,377 | 8/1973 | Knapp . | |
| 3,786,974 | 1/1974 | Kron | 226/19 |
| 3,885,600 | 5/1975 | Altmann . | |
| 3,900,141 | 8/1975 | Duckworth . | |
| 3,912,193 | 10/1975 | Calvaer | 226/20 X |
| 3,936,915 | 2/1976 | Becker . | |
| 3,949,281 | 4/1976 | Young, Jr. . | |
| 4,068,789 | 1/1978 | Young, Jr. et al. . | |
| 4,146,797 | 3/1979 | Nakagawa | 226/20 X |
| 4,217,682 | 8/1980 | Young, Jr. et al. . | |
| 4,322,026 | 3/1982 | Young, Jr. . | |
| 4,392,910 | 7/1983 | Tokuno et al. . | |
| 4,447,937 | 5/1984 | Young, Jr. . | |
| 4,494,740 | 1/1985 | Noboru et al. . | |
| 4,578,845 | 4/1986 | Young, Jr. . | |
| 4,700,642 | 10/1987 | Hankinson . | |
| 4,728,800 | 3/1988 | Surka . | |
| 4,817,254 | 4/1989 | Poterala . | |
| 4,829,918 | 5/1989 | Young, Jr. . | |
| 4,991,761 | 2/1991 | Gnuechtel et al. | 226/15 |
| 5,042,121 | 8/1991 | Young, Jr. . | |
| 5,067,646 | 11/1991 | Young, Jr. et al. . | |
| 5,119,981 | 6/1992 | Gnuechtel et al. . | |
| 5,126,948 | 6/1992 | Ko . | |
| 5,252,991 | 10/1993 | Storlie et al. . | |
| 5,255,419 | 10/1993 | Stanislaw et al. . | |
| 5,320,267 | 6/1994 | Oono et al. . | |
| 5,328,072 | 7/1994 | Ruessmann et al. | 226/15 |
| 5,373,613 | 12/1994 | Young, Jr. et al. . | |

FOREIGN PATENT DOCUMENTS

| | | |
|---|---|---|
| 410859 | 5/1934 | United Kingdom . |

*Primary Examiner*—Michael Mansen
*Attorney, Agent, or Firm*—Dority & Manning, P.A.

[57] ABSTRACT

A method and apparatus are provided for maintaining the edge of a moving web on a web handling apparatus at a desired operating path. The operating path of a web edge is monitored with respect to a first desired edge path. The web is secured for movement along an intended path of travel. The web edge is maintained at the first desired edge path. The web edge is monitored with respect to a second desired edge path as it is maintained on the first desired edge path. The web is automatically maintained along the second desired edge path.

34 Claims, 8 Drawing Sheets

APPARATUS AND METHOD FOR CONTROLLING MOVING MATERIAL AND THE LIKE

BACKGROUND OF THE INVENTION

The invention relates to a method and apparatus for controlling moving material and the like, and, more particularly to improved method and apparatus for achieving a desired operating path of a web edge during movement of the web in a desired path of travel.

It is a common practice in manufacturing operations involving indefinite length of materials such as fabrics to transport the fabric in a desired path of travel for processing and/or collection. Typically, in textile manufacturing operations, textile fabrics in indefinite length form are longitudinally moved in a path of travel for treatment, inspection, and/or collection in roll form. In such operations, it is generally desirable that the fabric be secured close to its edges for effective processing and minimization of waste.

In the general operation of tenter frames, for example, fabric enters the machine at one end where it is engaged along its edges or selvages, by a series of upwardly extending pins which penetrate the fabric material. The pins are, in turn, secured to and supported by two endless tenter chains. The fabric is thus held along its opposite edges by the upwardly extending pins for the full period of travel through the tenter frame where it may be subjected to various treatments, for example, washing, drying, and dying.

Typically, tenter frames transversely maintain the fabric as its moves longitudinally through its path of travel. The selvages are typically reinforced to prevent the fabric edges from tearing where they are secured by the pins.

It is also desirable to secure the fabric near the selvages to reduce waste, since the selvage areas must often be trimmed from the finished fabric. One difficulty with consistently pinning the fabric at the selvages is that the fabric may transversely shift as it enters the machine. Additionally, a fabric edge itself may be uneven. If the tenter frame fails to pin an area of the fabric, a gap is produced, particularly when the fabric is stretched downstream. These gaps must be cut out from the finished material, causing waste, inefficient product handling and possibly machine down time.

Thus, while on one hand it is desirable to pin the fabric as close to the longitudinal edge as possible to prevent trimming waste, it is on the other hand desirable to ensure pinning of the fabric deep enough inward from the longitudinal edge to avoid defects inherent from mispinning.

Accordingly, the two tenter frame endless chains are typically at least partially supported on corresponding frame members that are transversely adjustable with respect to the path of travel of the moving fabric. These frame members may be adjusted according to the variation of the fabric edge, attempting to secure the fabric near its edges while avoiding mispins.

To control the transverse adjustment of a frame member, it is known to monitor the operating path of a corresponding edge, for example its transverse position, upstream from the point at which it is secured by the frame member and to adjust the frame member to compensate for variations of the operating edge path from a desired edge path. In a typical arrangement, a detecting device is mounted on the frame member and employs photosensor devices to detect the presence or absence of the fabric edge.

When the fabric edge deviates from the desired edge path defined, for example, by the placement and configuration of the photosensor devices, the control device initiates the adjustment of the frame member in an appropriate direction to accommodate the edge deviation and to ensure that the fabric is pinned at a generally consistent distance from the longitudinal edge. Thus, the operating edge path achieves the desired edge path.

One difficulty arising from the use of such systems results from color variation of fabrics often run on tenter frames. Color effects may be such that a control system might react too slowly, or not at all, when fabrics of certain colors are run on the tenter frame. Thus, for example, a tenter frame may tend to pin a lighter color fabric nearer its edge than a darker color.

One method of alleviating such problems associated with fabric color is to adjust the intensity of light emitted by the photosensor light source according to fabric color. Such a practice may be inefficient if such adjustments are frequently required. Additionally, light intensity increases may cause control system malfunctions due to reflections from background objects.

Another difficulty encountered with such control systems is that dust and fabric particles frequently collect on photosensor surfaces. This may inhibit photosensor operation and decrease the control system's effectiveness.

Furthermore, typical fabric edges are relatively uneven and may have strings and other abnormalities. Typical tenter frame control devices attempt to adjust the frame members according to the position of the edge. The edge variations may cause unnecessary and overly frequent frame member adjustment.

Furthermore, control systems generally adjust the speed at which corrections are made to frame member position according to the distance the edge deviates from a desired position. Such systems typically vary the correction speed proportionally to the position of the edge within the detection area of one or more photosensors. For example, frame member correction speed may increase as the fabric edge moves across the detection area. Greater speed variation may be achieved by adding photosensors on either side of the fabric edge desired position.

Such control systems may not react fast enough in response to gross fabric edge deviations. If they are configured to increase speed quickly as the fabric edge moves away from the desired position, the frame member may also move quickly as the edge returns, potentially causing the frame member to overshoot the desired position.

Another difficulty encountered in such arrangements arises from the conflict between the need to pin as close to the longitudinal edge as possible and the general tendency of textile machine operators to overcompensate against mispinning by pinning the fabric farther inward, or deeper, from the longitudinal edge. Operators may adjust the desired edge path, by adjusting the detecting device, to cause the pins on the frame member to pin the fabric at a consistently deep position with respect to the longitudinal edge. That is, the adjustment of the desired edge path by the operator causes the adjustment of the operating edge path such that the fabric is more deeply pinned, resulting in increased waste fabric between the position at which the fabric is pinned and the longitudinal edge.

SUMMARY OF THE INVENTION

The present invention recognizes and addresses the foregoing disadvantages and others of prior art constructions and methods.

Accordingly, it is an object of the present invention to provide an apparatus and method for effectively controlling moving material and the like.

Some of these objects are achieved by an apparatus for handling a moving material of indeterminate length. The apparatus comprises a means for moving the material in an intended path of travel. The apparatus also comprises a detector assembly adjacent the path of travel for detecting deviation of at least one edge of the moving material from a corresponding desired operating path and initiating corrective reaction to the deviation to achieve the desired operating path. The reaction is defined in a predetermined relationship to the time the edge remains out of the desired operating path. The apparatus also comprises at least one adjustment device in operative communication with the detector assembly. The adjustment device adjusts the moving means in response to the detector assembly.

In one presently preferred embodiment, the detector assembly is configured to output corrective signals when the light intensity received by a photosensor receiver reaches a predetermined level. This predetermined level in turn corresponds to a certain transverse position of the material edge beneath the detector assembly.

In one presently preferred embodiment, the detector assembly is configured to output corrective signals when the light intensity received by a photosensor receiver reaches a predetermined level. This predetermined level in turn corresponds to a certain transverse position of the material edge beneath the detector assembly.

In another presently preferred embodiment, a detector assembly includes a control photosensor configured to detect edge deviation from a normal operating line, and an emergency photosensor located at a predetermined position inward from the control photosensor to detect gross edge deviation at an emergency line inward from the normal operating line. The detector assembly includes digital circuitry in communication with the control and emergency photosensors that outputs appropriate corrective signals responsively to the relationship between the edge and these lines. The detector assembly in one preferred embodiment includes a microprocessor.

The normal operating line is within a desired operating path for the material edge. The emergency line is inward from that line. That is, it is parallel to the normal operating line between the normal operating line and the center line of the moving material.

The emergency photosensor is utilized in this embodiment to react to gross inward deviations where the edge of the moving material is not pinned, clipped, or the like. When a deviation crossing the emergency line is detected, the detector assembly outputs corrective signals to the adjustment device causing the adjustment device to move the frame member inward at a relatively high emergency speed to pin or otherwise secure the edge at that inward deviation. In this presently preferred embodiment, the frame member is moved inward at the emergency speed as long as the emergency photosensor remains "uncovered," that is, as long as the material edge remains inward of the emergency line.

When the edge moves outward of the emergency line, or upon startup of the apparatus, the adjustment device positionally adjusts the frame member at a predetermined speed variation from startup or from the emergency speed to enable the pins to secure the edge and to achieve the desired operating path.

Once the emergency photosensor is covered, or if at startup the emergency photosensor is covered, the adjustment device adjusts the frame member inward or outward at predetermined speeds within predetermined time periods, depending on the position of the edge with respect to the normal operating line. The speeds and the time periods thereof are set so that a desired operating path may be achieved from the starting position of the edge. The speeds generally decrease over time and may permit oscillation of the edge over the normal operating line until the desired operating path is initiated.

The speed pattern occurs for a predetermined overall time period set to ensure that a generally uniform edge may reach the desired operating path regardless of its starting position.

It should be understood that positional adjustments may be made either to the frame member or to the moving material to achieve the desired operating path. For example, various apparatus are known for positioning and/or moving a material on a processing machine. One such apparatus is disclosed in U.S. Pat. No. 4,068,789, the disclosure of which is incorporated by reference herein. It should therefore be understood that the adjustment device may be configured to adjust the transverse position of the moving material in conjunction with such a device. Accordingly, the apparatus may adjust the relationship between the edge and the desired operating path in various equivalent manners. Thus, it should be understood that descriptions herein referring to the edge as "achieving" the desired operating path may generally refer to the change in relationship between the edge and the desired operating path, unless otherwise indicated. Furthermore, the apparatus of the present invention may be employed in conjunction with various web materials such as films or textile webs and various means for moving such materials, such as rolls and pinned endless chains.

In another presently preferred embodiment, the detector device is configured with the adjustment device to maintain the position of the frame member when the edge remains at the desired operating path. As discussed above, the edge is typically uneven and may contain relatively extreme, but brief, deviations such as strings. The edge nevertheless remains at the desired operating path as long as it varies over, within, or about the desired operating path within a predetermined time period. In this embodiment, the normal operating line is a benchmark for determining such variations.

If the edge deviates from the normal operating line longer than the predetermined time limit, the adjustment device moves the frame member in the appropriate direction at a predetermined speed. If the edge does not cross the normal operating line within a predetermined time, the speed is increased. Any number of stepped increases may be provided.

One presently preferred embodiment of the method according to the present invention for handling a material of indeterminate length comprises the steps of moving the material at least partially through a material handling apparatus along an intended path of travel, detecting deviation of at least one edge of the moving material from a corresponding desired operating path, and initiating corrective reaction of the material handling apparatus when the at least one edge is determined to be outside its desired operating path, the corrective reaction being of a predetermined speed with predetermined speed changes effectuated upon time lapsed from the initiation of the corrective reaction.

Furthermore, some of these objects are achieved by a method for maintaining an edge of a moving web on a web handling apparatus at a desired operating path. The method comprises the steps of monitoring the operating path of at least one edge of the web with respect to a first desired edge path, securing the web inwardly from opposite edges of the web for movement along an intended path of travel, and maintaining the at least one web edge along the first desired edge path. The method also includes monitoring the operating path of the at least one web edge maintained at the first desired edge path with respect to a second desired edge path and automatically maintaining the at least one web edge along the second desired edge path.

In one presently preferred embodiment, an upstream detecting device monitors the position of a longitudinal edge of the moving web with respect to the first desired edge path upstream from the point at which the web is secured for movement along the intended path of travel. The upstream detecting device detects edge deviations from the first desired edge path and initiates corrective reactions such that the operating edge path achieves the first desired edge path, for example as described above.

In this embodiment, the corrective reaction includes adjusting the position at which the web is secured for travel on a material handling apparatus. The web may be secured by pins on pin plates carried by an endless chain supported by a frame member on the apparatus. Thus, a waste area is defined between the longitudinal edge and the position at which the pins secure the web.

A downstream adjustment device adjusts the frame member and, consequently, the position at which the web is pinned, in response to the upstream detecting device to compensate for edge variations from a first desired edge path. In this way the operating edge path achieves the first desired edge path.

As noted above, however, if the first desired edge path is set to maintain an operating edge path causing the web to be pinned too far inward of the longitudinal edge, an excessive waste area is created. It is therefore desirable to maintain the operating edge path at a second desired edge path to optimize the waste area. Preferably, the second desired operating edge path is a desired position of the longitudinal edge with respect to the position at which the web is pinned. Accordingly, a downstream detecting device monitors the position of the longitudinal edge with respect to the second desired edge path after the moving web is secured by the pins.

In a preferred embodiment, the downstream detecting device comprises a photosensor assembly including a fiber optic element and is configured to detect the presence of any object within a predefined area below the fiber optic element. The photosensor assembly is positioned above the pin plates such that the pin plates pass through this predefined area. The photosensor assembly thus detects the presence of the pin plates but also the absence of plates as gaps between the plates pass through the predefined area.

Due to the relatively high speeds at which the pin plates pass under the photosensor assembly, the fiber optic element is preferably used because it has a more narrowly focused detection area than typical photocell arrangements. The fiber optic element configuration is, thus, generally better capable of detecting the individual gaps. It should be understood by those of ordinary skill in the art, however, that any suitable type of detecting device, possibly including photocell devices, may be employed.

The fiber optic element is positioned proximate the second desired path of the longitudinal edge. In one preferred embodiment, it is positioned above a line along which the longitudinal edge might ideally travel. If the longitudinal edge maintains a position inward from the ideal line as the web is carried along its intended path of travel, the fiber optic element would detect each gap passing below the photosensor assembly.

A benchmark measurement in this preferred embodiment is the number of gaps expected to be detected by the photosensor assembly in a given sampling period if the longitudinal edge maintains a position inward of the second desired edge path. The benchmark measurement may be derived, for example, from the rate at which the plates are traveling and the distance between the gaps. If the longitudinal edge varies outwardly from the second desired edge path, the web will obscure the detection of gaps by the photosensor assembly. Thus, a comparison between an actual measurement of the gaps detected during the sampling period with the benchmark measurement would indicate that the longitudinal edge has deviated from the second desired edge path and that the web is being pinned too far inwardly of the longitudinal edge. Conversely, if the actual measurement equals the benchmark measurement, the web is probably being pinned too close to the longitudinal edge.

Because the edge of a material web is typically uneven, the edge will typically vary over the ideal line even if it were not to deviate from the second desired edge path. These typical edge variations, as should be understood by those of ordinary skill in the art, are predictable. Thus, the interference with detection of the gaps that these edge variations cause are also predictable and can be accommodated by the benchmark measurement.

Although it should be understood that a sensor might be designed to count the number of gaps detected within the sampling period and to output a signal corresponding thereto, and that such a device is encompassed by the present invention, the photosensor assembly of this preferred embodiment outputs a signal each time a gap is detected by a fiber optic element. A comparing device including a high speed counter receives these signals. The comparing device includes a control processor which causes the high speed counter to count the number of signals received from the photosensor assembly during the sampling period. The control processor then compares the actual measurement with the benchmark measurement. If the comparison indicates that the longitudinal edge has deviated from the second desired edge path, the comparing device outputs a signal to initiate correction of the first desired edge path.

The adjustment of the first desired edge path causes the adjustment of the operating edge path as described above. Thus, by adjusting the first desired edge path, the operating edge path tends to achieve the second desired edge path.

In a preferred embodiment, the upstream detecting device includes a photosensor assembly configured to detect the position of the longitudinal edge. Movement of the upstream photosensor assembly changes the area in which the longitudinal edge may be detected, thus changing the first desired edge path. Accordingly, an upstream adjustment device includes a mechanized screw assembly configured to receive the corrective signals from the comparing device and to adjust the position of the upstream detecting device responsively to those signals.

It should be understood by those of ordinary skill in the art that the present invention includes sensing for any suitable characteristic of a material handling apparatus element from a detection position. A suitable characteristic is distinguishable from the longitudinal edge of the web by a detecting device from a detection position proximate the apparatus element and the second desired edge path. The position of the longitudinal edge with respect to the second desired edge path at least in part determines whether the characteristic may be detected from the detection position.

For example, endless belts or roller devices may be used to move the web through the intended path of travel. Such devices may be provided with markings or other features detectable by a detecting device. All such suitable constructions are encompassed by the present invention.

The accompanying drawings, which are incorporated in and constitute a part of this specification, illustrate an exemplary embodiment of the invention and, together with the description, serve to explain the principles of the invention.

BRIEF DESCRIPTION OF THE DRAWINGS

A full and enabling disclosure of the present invention, including the best mode thereof, directed to one of ordinary skill in the art is set forth in the specification, the remainder of which makes reference to the appended drawings in which:

FIG. 1A is a cross-sectional view of a carrier device for use with the tenter frame as in FIG. 1;

Figure 1:
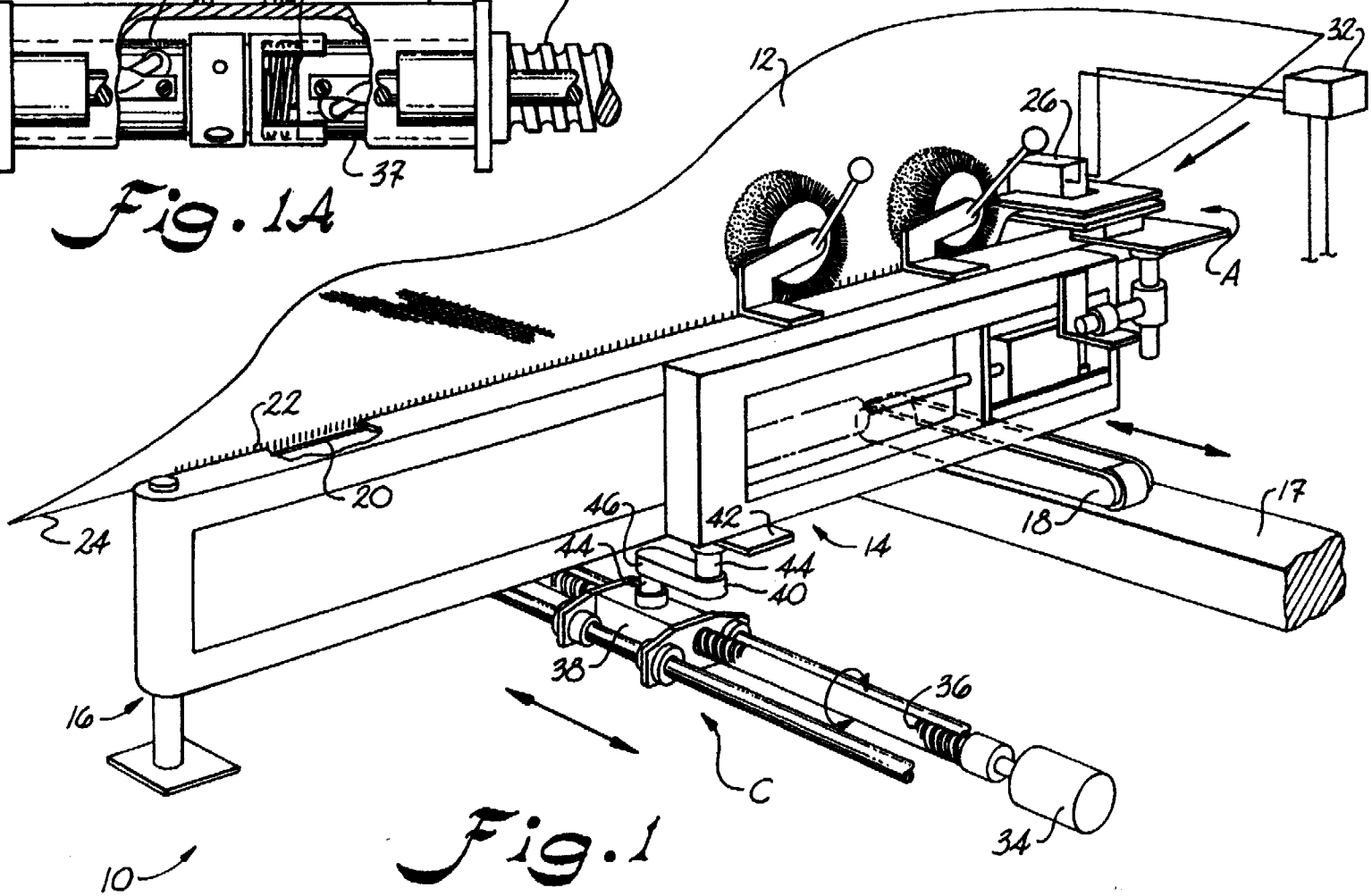
FIG. 1 is a partial perspective view of a tenter frame constructed in accordance with the present invention.
Figure 14:
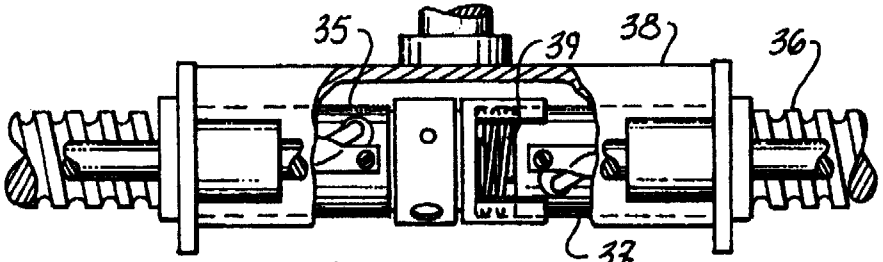

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention cover such modifications and variations as come within the scope of the appended claims and their equivalents.

The present invention is concerned with an apparatus and method for controlling a moving material and the like. Accordingly, FIG. 1 depicts a presently preferred embodiment of a tenter frame, shown generally at 10, for spreading and transporting open widths of a moving web, such as fabric 12. The tenter frame includes a pair of frame devices configured to transport moving fabric 12. One frame member is indicated generally at 14. Frame member 14 is pivotally joined at 16 to the main body (not shown) of tenter frame 10. Frame member 14 is supported at its opposite end by cross member 17 on roller carriage 18. Roller carriage 18 is configured to move along cross member 17 as indicated. Thus, frame member 14 is transversely adjustable with respect to fabric 12 about pivotal connection 16.

Frame member 14 at least partially supports an endless chain 20. Endless chain 20 has a plurality of pins 22 for engaging a longitudinal edge 24 of fabric 12. U.S. Pat. Nos. 5,373,613 and 5,042,121 generally describe the operation of a tenter frame, particularly with regard to pinning fabric edges. The disclosures of these patents are incorporated by reference herein.

Fabric 12 enters tenter frame 10 at front end A in the direction indicated. Tenter frame 10 also includes a control device associated with each frame member 14 for adjusting the transverse position of frame member 14 in response to movements of fabric 12 or variations in edge 24 so that edge 24 may be effectively pinned by pins 22.

Figure 5:
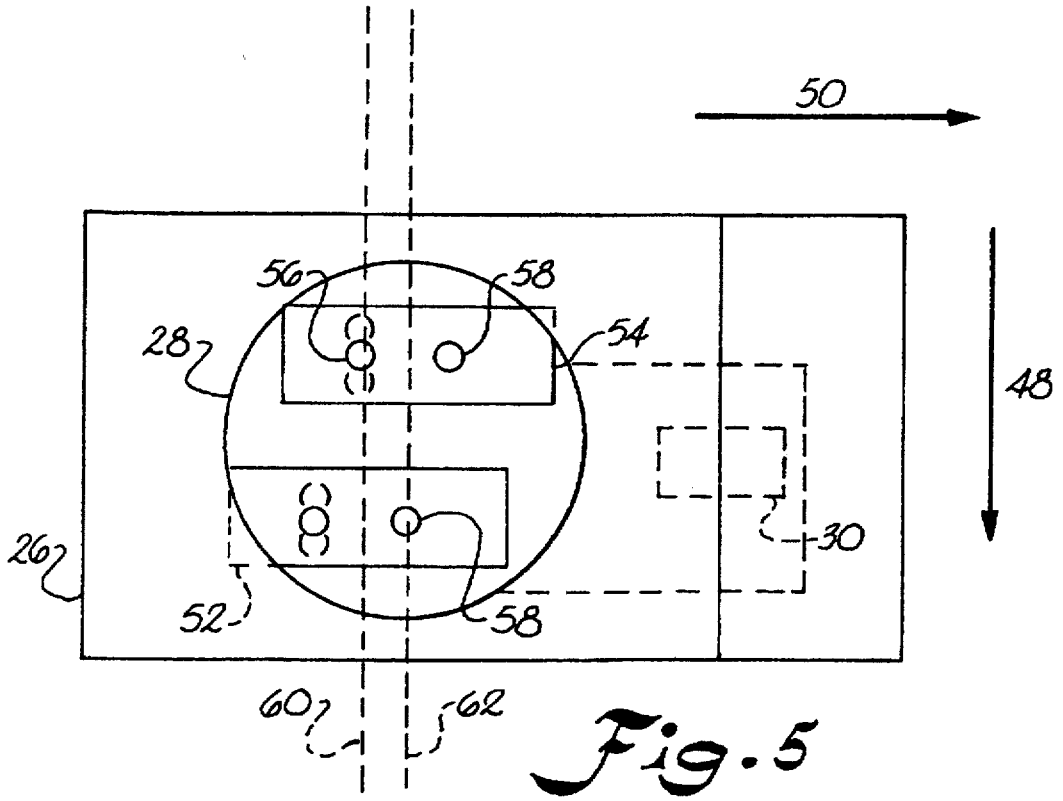
FIG. 5 is a partial bottom view of a control device constructed according to the present invention.
Figure 6:
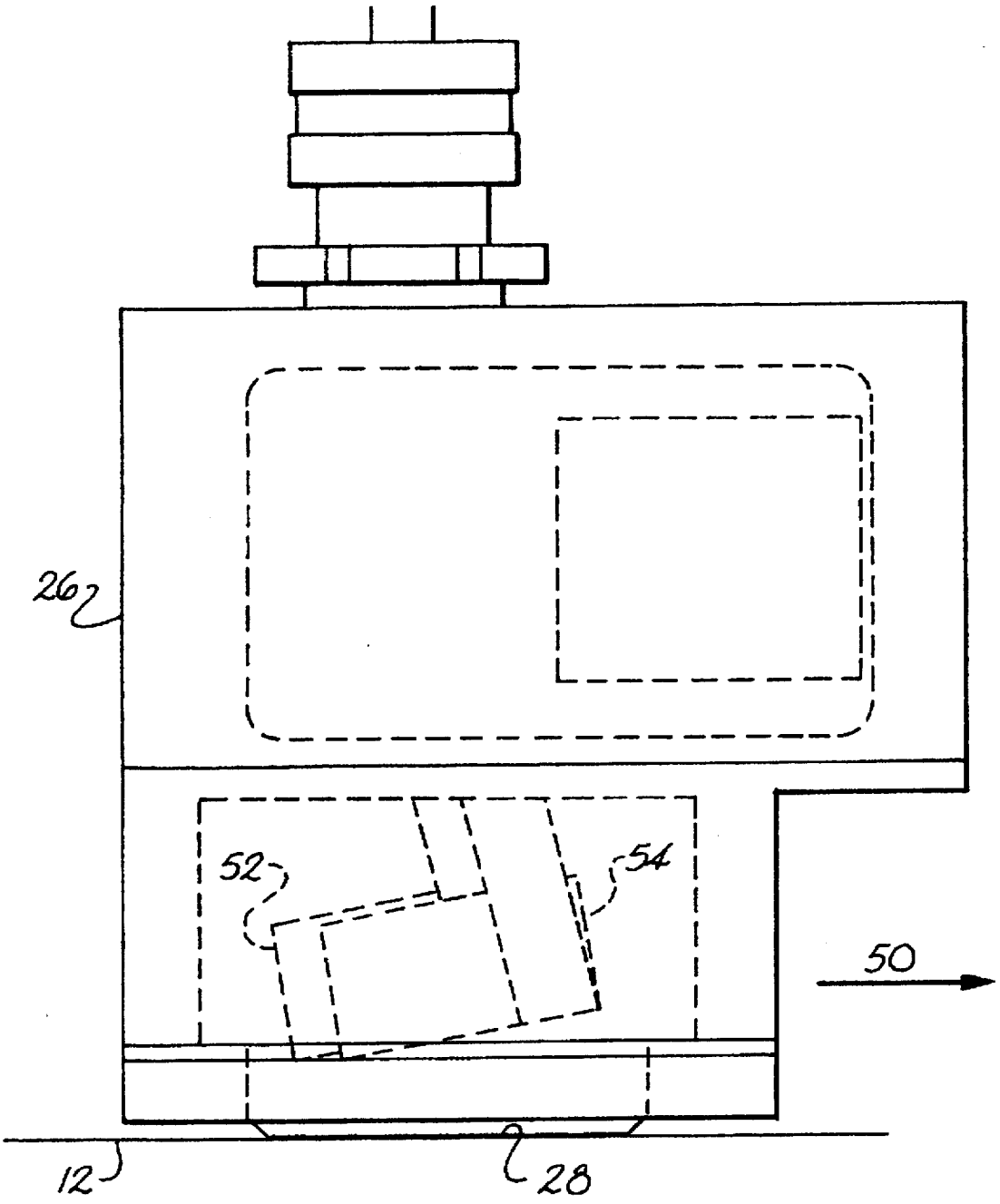
FIG. 6 is a partial side view of a control device as in FIG. 5.

The control device includes at least one detector assembly 26 proximate moving fabric 12 configured to monitor fabric edge 24. Detector assembly 26 may thus detect deviation of edge 24 from a desired edge path. As shown in FIG. 5, detector assembly 26 has a transparent front face 28. Referring to FIG. 6, front face 28 of detector assembly 26 abuts moving fabric 12.

Detector assembly 26 also includes a microprocessor, shown in FIG. 5 in phantom at 30, configured to receive detection signals from detectors housed in detector assembly 26 and to output signals corresponding to corrective reactions to edge deviation from a desired edge path. The corrective signals here initiate adjustment of frame member 14 at predetermined speeds.

It should be understood by those of ordinary skill in the art that various configurations of detector assembly 26 are possible. For example, microprocessor 30, or any equivalent device capable of executing predetermined arithmetic or logic functions, may be remotely located from photosensors housed by the assembly. Furthermore, digital or analog circuitry may be employed to perform equivalent functions of microprocessor 30.

It should also be understood by those of ordinary skill in the art that photosensor detectors may sometimes be affected by fabric color and that it is sometimes necessary when using such detectors to vary the light intensity of the detectors as fabrics of various colors are run on the apparatus. Such intensity variations may cause undesirable background reflections. Applicant has found that the use of a triangulation background suppression sensor reduces such difficulties.

The control device also includes a downstream adjustment device C in operative communication with frame member 14 and detector assembly 26. Downstream adjustment device C is configured to receive corrective signals from microprocessor 30 and to positionally adjust frame member 14 in response thereto to achieve the desired edge path.

The control device also includes interface device 32 that includes an amplifier for amplifying the output of microprocessor 30 to a level acceptable to adjustment device C.

Motor 34 drives a motive assembly that includes a ball screw assembly. The ball screw assembly includes threaded rod 36, carrier 38, and self-aligning linkage 40 connected to frame member 14 by plate 42.

Motor 34 receives corrective signals from detector assembly 26 through interface 32 and drives threaded rod 36 responsively thereto. Depending on the rotation of threaded rod 36, carrier 38 moves in either transverse direction with respect to fabric 12 as indicated. In a presently preferred embodiment, threaded rod 36 and carrier 38 are surrounded by a housing (not shown) having a movable strip at the top thereof configured to permit the movement of linkage 40 in conjunction with carrier 38. For purposes of clarity, the housing is not shown.

An interior view of carrier 38 is provided in FIG. 1A. Ball nuts 35 and 37 receive threaded rod 36. Spring 39 exerts pressure against nuts 35 and 37. As should be understood by those of ordinary skill in the art, such an anti-backlash configuration substantially prevents jolts in carrier 38 when threaded rod 36 starts and stops rotating. This permits adjustment device C to more precisely respond to detector assembly 26.

Referring again to FIG. 1, self-aligning linkage 40 includes two vertical posts 44 and a horizontal member 46. Adjustment device C is thus configured to transversely adjust the position of frame member 14 to effectively pin fabric edge 24 downstream from photosensor assembly 26.

Tenter frame 10 includes two endless chains 20, frame members 14, and control devices on either side of fabric 12. The configuration on either side operates independently of the other. Thus, for example, the apparatus may accommodate edge deviations as well lateral shifts of fabric 12.

Figure 4:
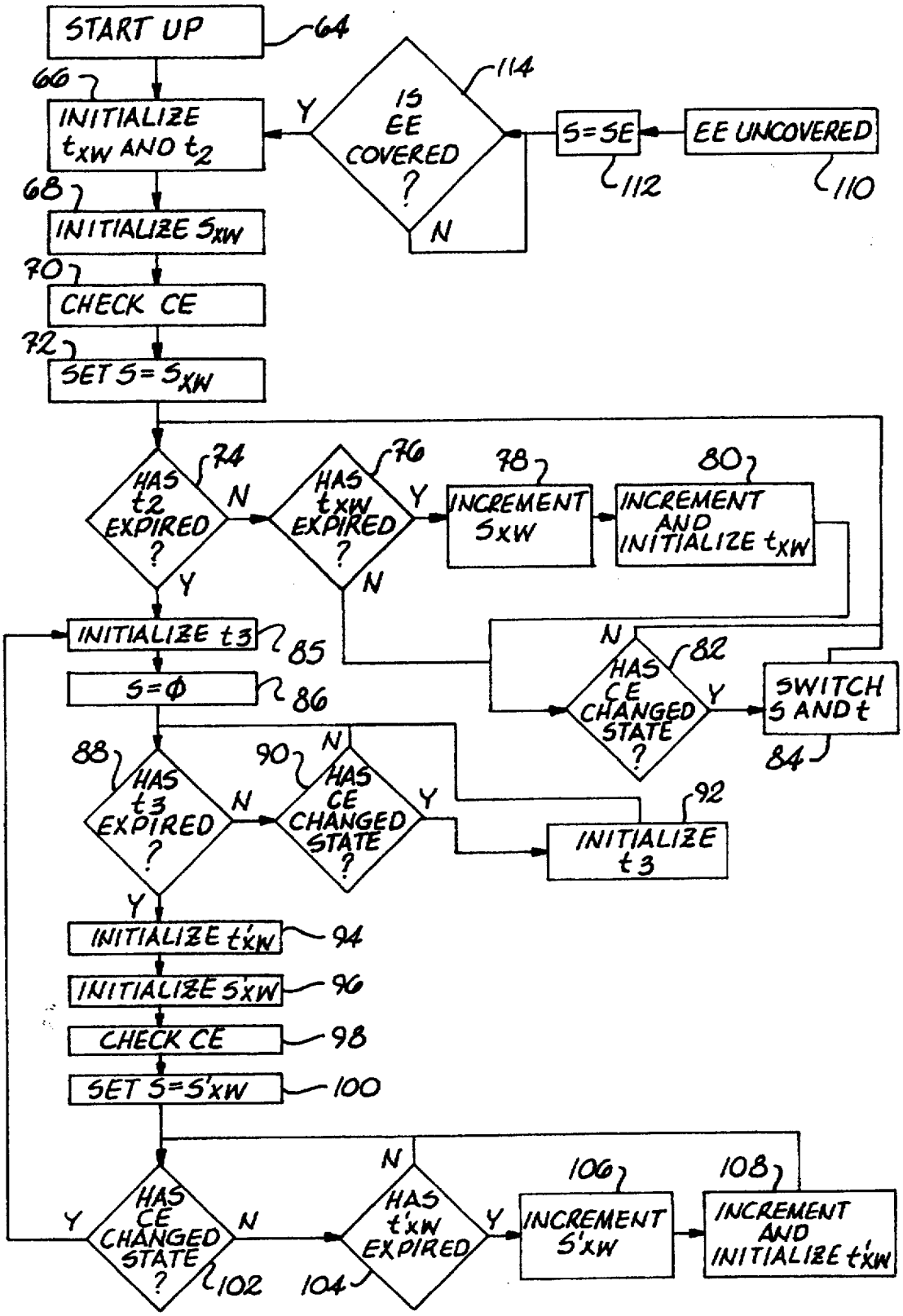
FIG. 4 is a diagrammatic illustration of one embodiment of the method according to the present invention.

A functional illustration of one embodiment of the method of the invention is provided in FIG. 4. The steps of FIG. 4 may be, for example, embodied within a program performed by microprocessor 30. It should be understood that the illustration of FIG. 4 is provided by way of example only and not by way of limitation. For example, various equivalent functions, programs, circuitry and the like are encompassed by the scope and spirit of the present invention.

Referring to now to FIG. 5, a bottom view of detector assembly 26 is provided. Fabric flow is indicated at 48. Inward direction 50 indicates the position of the center line of fabric 12 with respect to detector assembly 26.

Detector assembly 26 includes a control photosensor 52 and an emergency photosensor 54. Each photosensor includes a light source 56 and a light receiver 58. A normal operating line 60 may be defined for a particular fabric generally beneath control photosensor 52, and an emergency line 62 may be defined generally beneath emergency photosensor 54.

Referring now to FIG. 4, upon tenter frame startup at 64, time variables $t_{xw}$ and $t_2$ are initialized at 66. Speed variable $S_{xw}$ is initialized at 68. An exemplary illustration of speeds $S_{xw}$ and time variables $t_{xw}$ and $t_2$ are provided in FIG. 2. It should be understood that this illustration is provided for ease of explanation only and does not constitute a limitation on the present invention. For example, first outward time period $t_{01}$ need not equal first inward time period $t_{I1}$. Similarly, the magnitude of first inward speed $S_{I1}$ need not equal the magnitude of first outward speed $S_{01}$.

Figure 2:
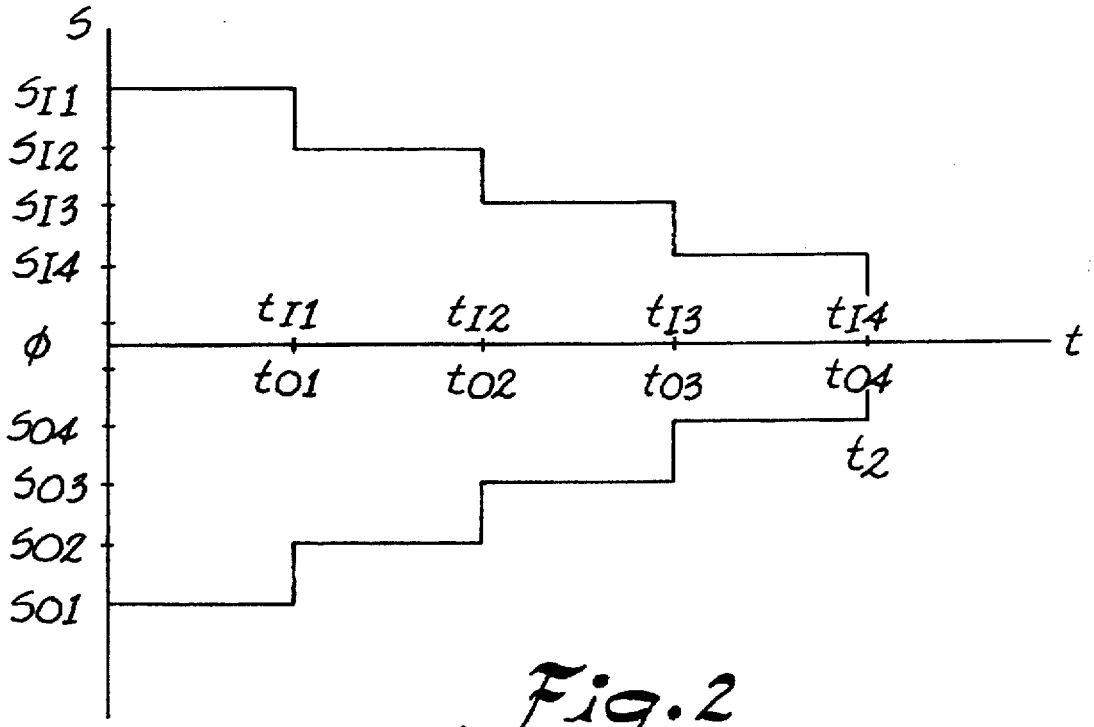
FIG. 2 is a diagram illustrating exemplary speed variations from apparatus startup or from an emergency condition.

The state of the control photosensor 52 is checked at 70. If fabric edge 24 is outward from normal operating line 60, control photosensor 52 is "covered." Frame member 14 should therefore move outward. Thus, speed S of frame member 14 is set at 72 to the first outward speed $S_{01}$. The time variation pattern of FIG. 2 is followed for the duration of time period $t_2$. Accordingly, if $t_2$ has not expired at 74, $t_{XW}$ is checked at 76. The time variable $t_{XW}$ represents the individual time periods associated with the various speeds illustrated in FIG. 2. Beginning at time zero, both the outward and inward timing sequences are clocked, regardless of the direction frame member 14 is actually moving. Thus, if a time period $t_{XW}$ expires at 76, the speed $S_{XW}$ is incremented to the next level at 78 and the next time variable $t_{XW}$ is initialized at 80.

If the control photosensor 52 has not changed state (gone from "covered" to "uncovered" or vice versa), $t_2$ is again checked at 74. If the control photosensor has changed state at 82, speed S is switched at 84 from an outward to an inward speed or vice versa.

For example, again assuming that speed S begins at $S_{01}$, time periods $t_{01}$ and $t_{I1}$ are repeatedly checked at 76. If $t_{01}$ expires before control photosensor 52 changes state, speed S changes from $S_{01}$ to $S_{02}$ at 78. If $t_{I1}$ expires before the control photosensor changes state, $S_{I1}$ will increment to $S_{I2}$ at 78 but will not affect the adjustment of frame member 14 which is running at the outward speeds.

If the control photosensor changes state before $t_{01}$ or $t_{I1}$ expire, speed S switches from $S_{01}$ to $S_{I1}$ at 84. This means that frame member 14 moved outward such that edge 24 crossed inward of normal operating line 60. Accordingly, the adjustment speed is altered so that frame member 14 moves inward. The process continues through successive speeds $S_{XW}$ and time periods $t_{XW}$ until $t_2$ expires.

Speeds $S_{XW}$ and time periods $t_{XW}$ and $t_2$ are set so that frame member 14 will start moving quickly toward a desired edge path. It should be understood that various equivalent configurations and steps may be employed to adjust frame member 14 at a predetermined speed variation from a startup or emergency condition to initiate a desired edge path. For example, a linear or geometric speed variation may be employed instead of the step variation shown in FIG. 2. Additionally, multiple control photosensors may be used.

When $t_2$ expires, fabric edge 24 and normal operating line 62 should be relatively close. To maintain a desired edge path, time period $t_3$ is initialized at 85 and frame member 14 is stopped at 86. Because typical fabric edges are uneven, the position of moving fabric edge 24 measured at a stationary point should vary. As long as control photosensor 52 detects such a variation, fabric edge 24 remains in a the desired edge path and frame member 14 remains stationary.

Accordingly, the detector assembly monitors control photosensor 52 to detect state changes within time period $t_3$. $t_3$ is set depending on tenter frame speed. The speed at which the fabric edge moves over the control photosensor in part determines the rate at which the control photosensor will change state. Applicant has found that a period of 0.2 seconds is one appropriate setting for a tenter frame running at 100 yards per minute. The control device may be configured to automatically change this time period as tenter frame speed changes.

Before $t_3$ expires at 88, the control photosensor state is repetitively checked at 90. As long as the control photosensor changes state before $t_3$ expires, $t_3$ will be reinitialized at 92. Thus, as long as fabric edge 24 varies over the control photosensor within $t_3$, the desired edge path and, thus, the stationary position of frame member 14, is maintained.

The failure of control photosensor 52 to change state over time period $t_3$ indicates that fabric edge 24 has deviated from the desired edge path. The control device then generates appropriate corrective signals to adjustment device C corresponding to corrective speeds varying in a predetermined relationship to time edge 24 remains out of the desired edge path.

Figure 3A:
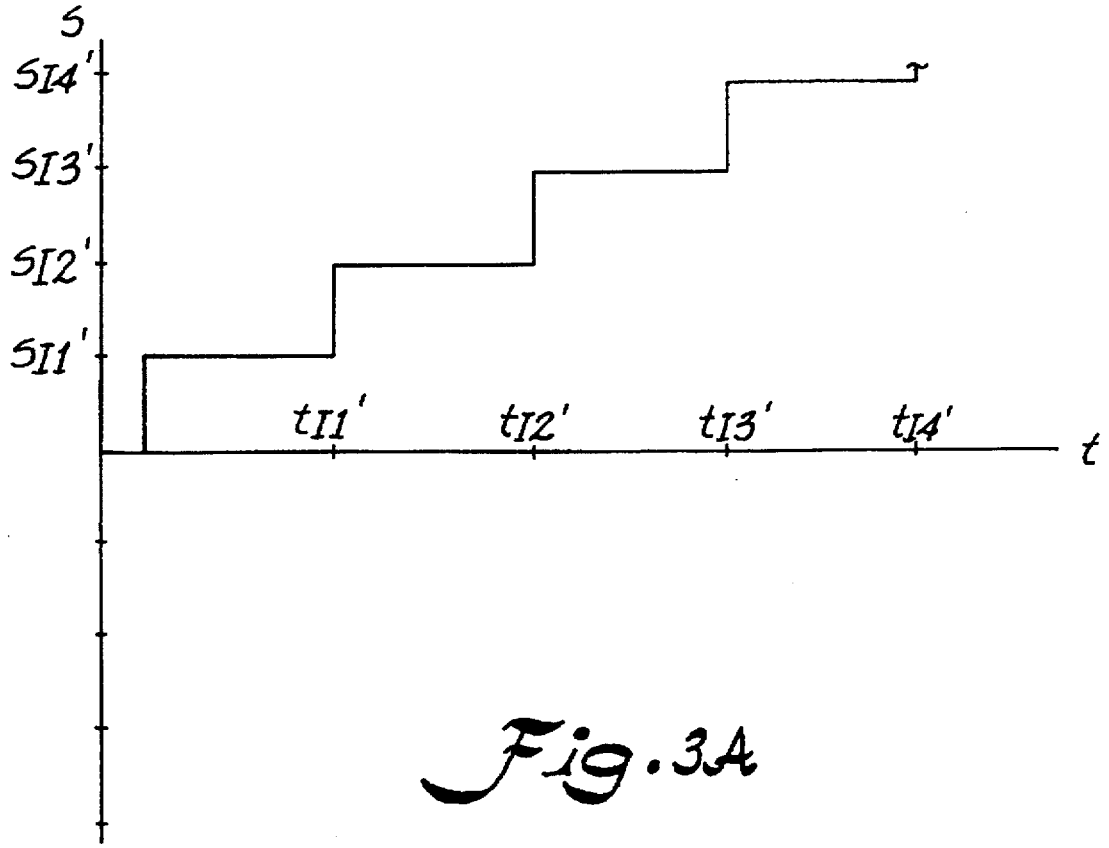
FIG. 3A is a diagram illustrating an exemplary inward speed variation responsive to deviation of a material edge from a desired edge path.
Figure 3B:
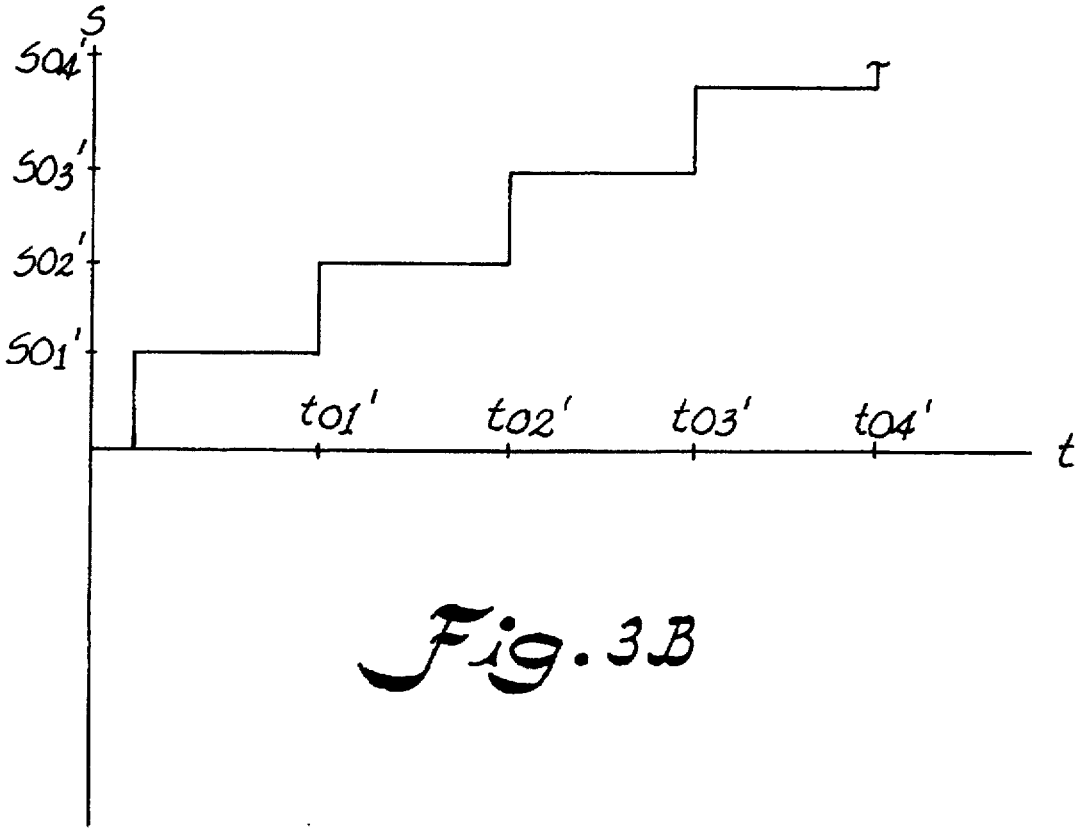
FIG. 3B is a diagram illustrating an exemplary outward speed variation responsive to deviation of a material edge from a desired edge path.

Referring now to FIGS. 3A and 3B, one exemplary illustration of such responsive speeds is provided. When $t_3$ expires at 88, predetermined outward and inward time periods $t_{XW}'$ are initialized at 94. Similarly, inward and outward speeds are initialized at 96. The state of the control photosensor is checked at 98 and speed is set accordingly at 100. For example, if fabric edge 24 extends outward from the desired edge path, speed S is set to $S_{O1}'$. If fabric edge 24 extends inward from the desired edge path, speed S is set to $S_{I1}'$.

If fabric edge 24 does not cross normal operating line 60 within $t_{X1}'$, frame member 14 should move more quickly to pick up edge 24. Accordingly, if control photosensor 52 has not changed state at 102 before $t_{X1}'$ expires at 104, speed S is increased at 106, $t_{X2}'$ is initialized at 108, and control photosensor 52 is checked again at 102. This process will ordinarily repeat until control photosensor 52 changes state, indicating that the desired edge path has been reachieved. At this point, $t_3$ is again initialized at 85.

It should be understood that various speed variation configurations may be employed, for example including linear or geometric variations of speed with respect to time. Any and all such equivalent configurations are understood to be within the scope and spirit of the present invention.

If at any time during the process illustrated by FIG. 4 the emergency photosensor 54 becomes uncovered (that is, fabric edge 24 moves inward of emergency line 62), an emergency condition exists. Such gross inward deviations from the desired edge path may cause undesirable gaps as described above.

Accordingly, if emergency photosensor 54 is uncovered at 110, speed S is set to emergency inward speed SE at 112. Frame member 14 will be moved at speed SE until emergency photosensor 54 is covered at 114. The apparatus then begins at 66 to initiate the desired edge path. The emergency inward speed is proportional to the tenter frame speed. Applicant has found that a minimum adequate such emergency speed is 30 percent of the tenter frame speed. Of course, the speed may be set according to specific operating requirements.

It should be understood by those of ordinary skill in the art that the relation between emergency line 62 and normal operating line 60 may vary depending on particular operation conditions. For example, it may be desirable to employ an emergency photosensor outward of control photosensor 52.

While one preferred embodiment of the invention has been described above, it is to be understood that any and all equivalent realizations of the present invention are included within the scope and spirit thereof. For example, the longitudinal frame member may include various configurations and attachments to the main tenter frame body. Furthermore, although the embodiments discussed herein include pins on endless chains, it is understood that various means and methods, for example including clips, endless belts, and roller devices may be employed to move the fabric in an intended path of travel. All such equivalent moving means are encompassed by the present invention. Additionally, detector devices may include, for example photosensors, lasers, or air devices. Thus, the embodiments depicted are presented by way of example only and are not intended as limitations upon the present invention.

Figure 7:
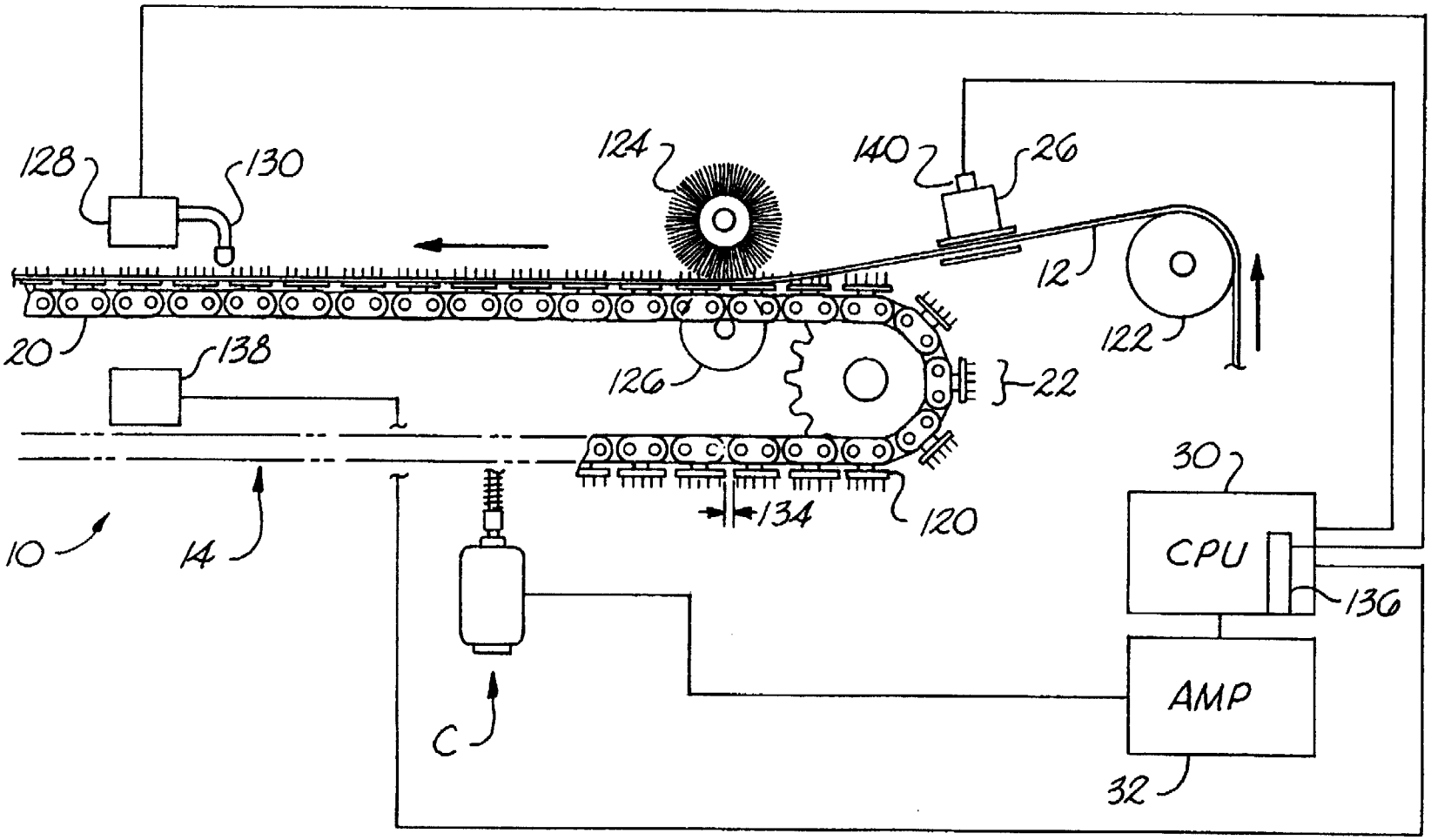
FIG. 7 is a schematic view of a tenter frame constructed in accordance with the present invention and including an upstream detecting device and a downstream detecting device.

A presently preferred embodiment of the present invention is schematically illustrated in FIG. 7. Frame member 14 of a tenter frame 10 supports an endless chain 20 supporting pin plates 120 having pins 22 disposed thereon for securing moving fabric 12 along an intended path of travel as indicated. It should be understood that, although the figures illustrate one row of pins 22, it is also known to use, for example, two rows. Such configurations are compatible with the present invention as are the use of other securing means such as clips.

Fabric 12 is fed to the frame member 14 over overfeed roll 122 through photosensor assembly 26 (hereinafter referred to as upstream detecting device 26) to pinning wheel 124. As should be understood by those of ordinary skill in the art, pinning wheel 124 forces fabric 12 onto pins 22 and is aided by nip roller 126. As discussed above, upstream detecting device 26 is physically mounted on frame member 14. For the sake of clarity, however, the frame structure of frame member 14 is not shown in FIG. 7.

Figure 8:
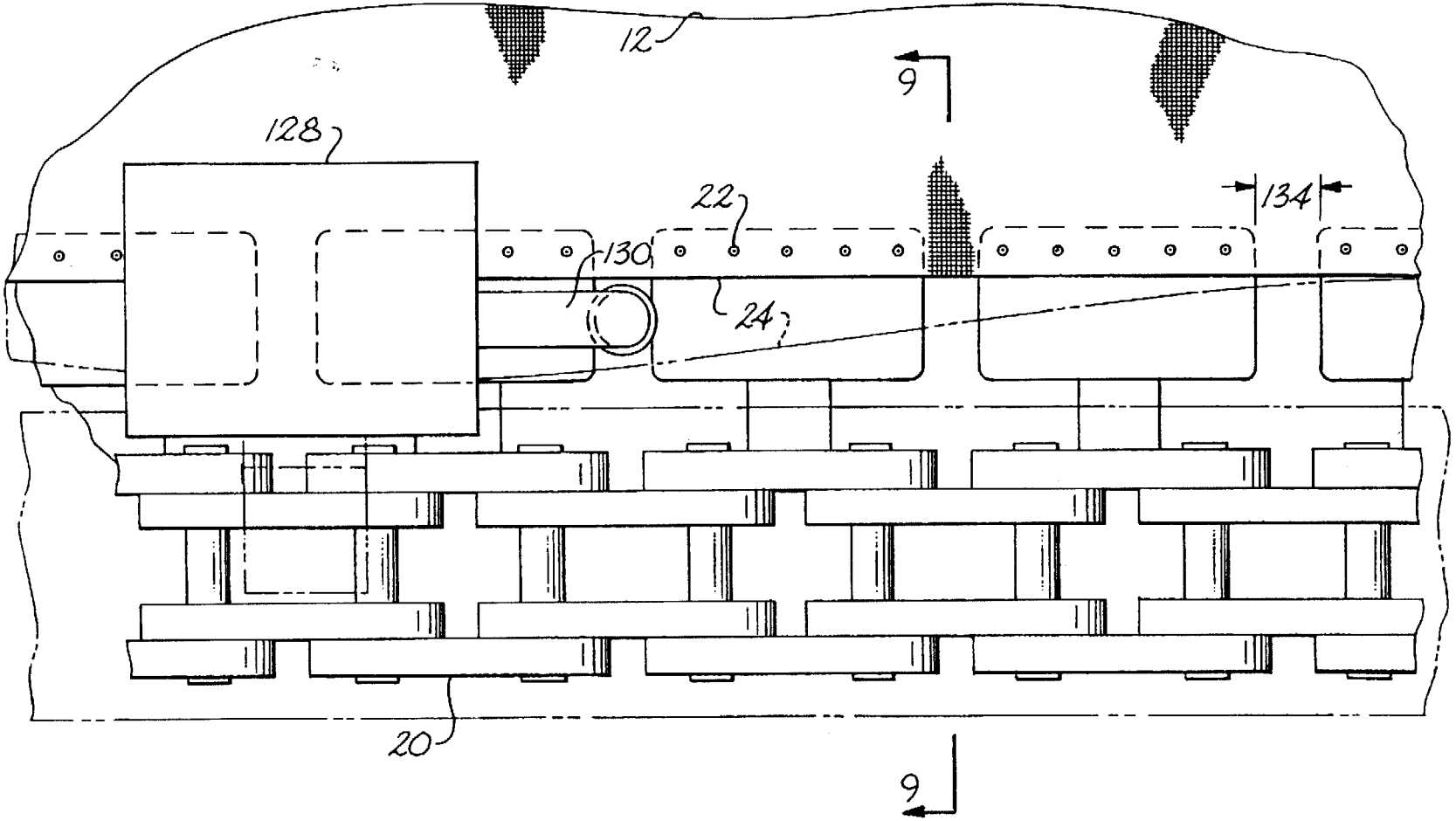
FIG. 8 is a top schematic illustration of an endless chain supporting pin plates securing a fabric and of a downstream detecting device constructed in accordance with the present invention.
Figure 9:
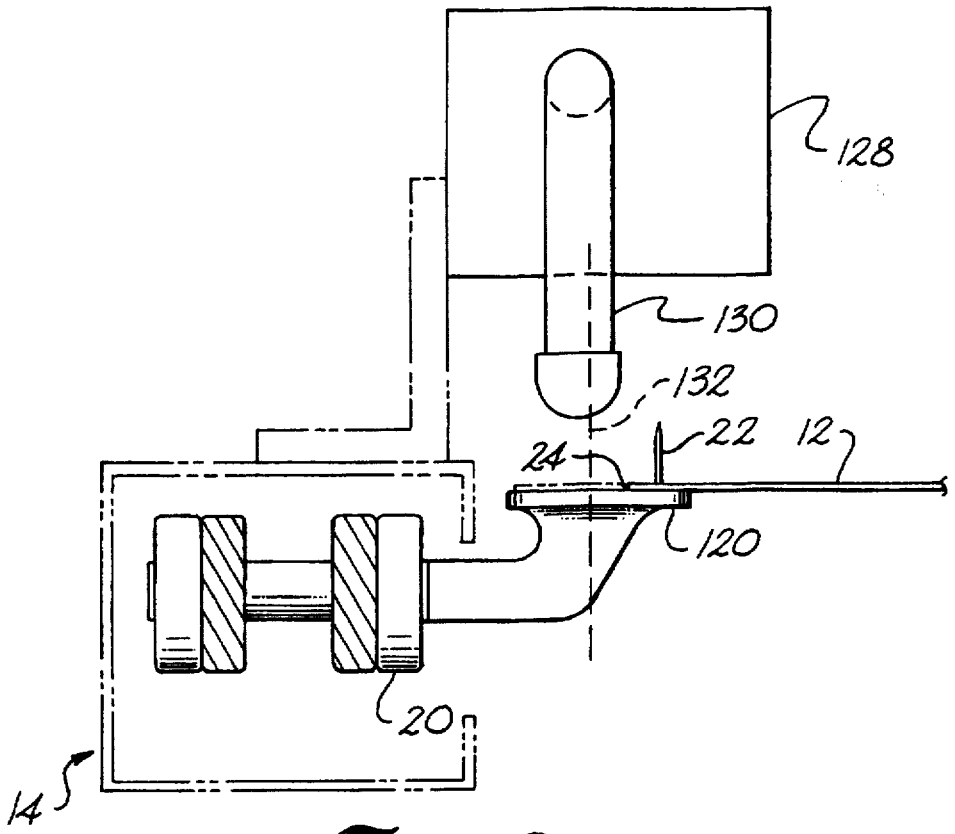
FIG. 9 is a front schematic illustration of the arrangement as in FIG. 8.

A downstream detecting device 128 includes a fiber optic element 130. As shown in FIGS. 7, 8 and 9, downstream detecting device 128 is located proximate pin plates 120. It is positioned above and immediately outward from a line 132 along which longitudinal edge 24 would ideally travel to optimize fabric waste between longitudinal edge 24 and pins 22.

In the preferred embodiment illustrated in FIG. 9, line 132 represents the point at which the position of edge 24 would cause assembly 128 to change state, that is—the point at which assembly 128 can or cannot detect a characteristic of pin plates 120 depending on the position of edge 24. As should be understood by those of ordinary skill in the art, this may not be an exactly predetermined position but, rather, may depend upon, for example, ambient conditions and assembly configurations.

As discussed above, the operating path of longitudinal edge 24 is determined as upstream detecting device 26 adjusts the transverse position of frame member 14 to achieve the desired edge path (hereinafter referred to as the first desired edge path). If an operator adjusts the first desired edge path by adjusting the upstream detecting device so that fabric 12 is pinned too deeply, excessive waste occurs. Referring to FIG. 9, if line 132 is the position of longitudinal edge 24 at which waste is optimized, such adjustment of the first desired edge path would cause longitudinal edge 24 to extend beyond line 132 away from the center of fabric 12. This would increase the distance between longitudinal edge 24 and pin 22 and, accordingly, increase fabric waste.

Downstream detecting device 128 monitors the operating path of longitudinal edge 24 after fabric 12 is secured by pins 22 with respect to a second desired edge path, here indicated by line 132. Although control systems are known which use detecting devices to detect the presence or absence of a moving fabric after pinning, the detecting devices of such systems are generally placed proximate the moving fabric inwardly from the pin plates or other securing means to detect mispins. Because there is generally no structure or other potentially interfering background, such detecting devices may use various understood methods of detecting the presence or absence of the fabric itself.

Monitoring the operating path of longitudinal edge 24 over an element of frame member 14 such as pin plates 120 requires the ability to distinguish fabric 12 from the background element. Conventional detecting devices configured to sense characteristics of the fabric are generally unable to make such a distinction.

For example, a detecting device configured to "search" for a change in color to indicate the presence or absence of the fabric may fail to detect a change in fabric position if the background element color is similar to the fabric color. Similarly, a detecting device configured to detect a change in distance between the detecting device and a target area as the fabric edge moves in and out of a detection area may be unable to properly identify edge variations due to the typical tendency of pin plates 120 to move vertically during tenter frame operation.

To monitor the position of longitudinal edge 24, downstream detecting device 128 senses for a characteristic of the apparatus element that is distinguishable from fabric 12 from the position indicated in FIGS. 7, 8 and 9. It should be understood by those of ordinary skill in the art that various characteristics may be utilized depending, for example, on the apparatus element. The apparatus element need not be a drive element. Furthermore, while the present discussion refers to the distinction between the element characteristic and the fabric 12, it should be understood that the distinction may be made regarding a specific area of fabric 12, in particular the edge or "selvage" area immediately adjacent longitudinal edge 24.

In the preferred embodiment illustrated in FIGS. 7 through 10, pin plates 120 are separated by gaps 134 having a width of approximately 1/16 inch. Downstream detecting device 128 is a photosensor assembly mounted to frame member 14 and configured to sense gaps 134 as they pass through a detection area immediately under the downstream detecting device. As long as longitudinal edge 24 remains inward of line 132 as illustrated in FIG. 9, downstream detection device will detect gaps 134. If, however, longitudinal edge 24 varies outward from line 132 as illustrated in FIG. 8, downstream detection device 128 will be unable to detect gaps 134. By comparing the actual number of gaps detecting by downstream detecting device 128 during a sampling period with the number of gaps expected to be detected during the sampling period if longitudinal edge 24 remains inward of line 132 during the sampling period, an indication of whether longitudinal edge 24 has varied from the second desired edge path defined by line 132 may be obtained.

As noted above, longitudinal edge 24 is typically uneven. Thus, it is expected that edge variations outward from line 132 will occur which do not indicate that longitudinal edge has varied from the second desired edge path. Because these edge variations are predictable, the expected number of detected gaps during the sampling period, or benchmark, may be adjusted accordingly. Thus, for example, on a tenter frame moving fabric 12 at approximately 100 yards per minute, typical edge variations may account for an approximately 30 percent reduction in the number of gaps detected by downstream detecting device 128 even if longitudinal edge 24 were to effectively remain at the second desired edge path. Accordingly, a deviation outward from the second desired edge path would not be indicated until the actual measurement falls below 70 percent of the original benchmark.

Referring again to FIG. 7, fiber optic element 130 of downstream detecting device 128 detects the presence and absence of gaps 134. A fiber optic element is preferable because its narrow detection area permits the detection of gaps 134 passing under downstream detecting device 128 at a relatively high rate of speed, for example 100 yards per minute.

Downstream detecting device 128 outputs signals corresponding to each detected gap directly to a high speed counter device 136, such as manufactured by SEIMENS. Counter 136 is an integrated circuit device in communication with processor 30 via a conventional expansion slot. Downstream detecting device 128 constantly outputs detection signals to high speed counter 136. To obtain an actual gap measurement, processor 30 activates high speed counter 136 for the sampling period, for example 3 seconds. High speed counter 136 then counts the number of detection signals received from, and thus counts the number of gaps detected by, downstream detecting device 128. At the end of the sampling period, processor 30 retrieves a signal from high speed counter 136 corresponding to the total number of gaps detected by downstream detecting device 128 during the sampling period. Processor 30 then deactivates high speed counter 136 after resetting it to 0. Processor 30 thus has an actual measurement of the gaps detected by downstream detecting device 128 during the sampling period.

Processor 30 also calculates a benchmark measurement for the sampling period from preset data relating to the distance between each gap 134 and from information carried by signals output by sensor 138 relating to the rate at which gaps pass beneath downstream detecting device 128. Sensor 138 is, for example, a sensor device measuring the operation of a driving mechanism driving chain 20 on frame member 14. Processor 30 monitors the output of sensor 138 during the sampling period and converts such data, along with the distance between gaps 134, to a benchmark measurement for the sampling period.

If the actual measurement output by high speed counter 136 is less than the benchmark measurement, which may be modified to account for predictable edge variations discussed above, a variation outward from the second desired edge path is indicated, and a correction signal is output by processor 30 to upstream detecting device 26.

If the actual measurement is equal to the benchmark measurement, a variation inward from the second desired edge path is indicated, and a correction signal is output by processor 30 to upstream detecting device 26. Thus, in this embodiment, the position of edge 24 is always adjusted either outwardly or inwardly. Line 132 is, therefore, an infinitely narrow line which edge 24 will not attain. The second desired edge path is maintained, however, when edge 24 oscillates over line 132 within a suitable range determined at least in part by the configuration of assembly 128. It should be understood, however, that various types of detection devices may be utilized which may define and maintain the second desired edge path in other suitable fashions without departing from the scope of the present invention.

The corrective signal from processor 30 is received by an upstream adjustment device 140. Upstream adjustment device 140 is configured to adjust the transverse position of upstream detecting device 26 with respect to fabric 12. As indicated above, the position of upstream detecting device 26 determines the position of the first desired edge path which, in turn, causes the adjustment of the operating path of longitudinal edge 24 with respect to frame member 14.

Accordingly, the present system defines a feedback loop. Upstream detecting device 26 defines the first desired edge path for longitudinal edge 24. Deviations of longitudinal edge 24 from the first desired edge path at upstream detecting device 26 cause the adjustment of frame member 14 such that the operating path of longitudinal edge 24 achieves the first desired edge path. Downstream detecting device 128 monitors the operating path of longitudinal edge 24 after being secured on frame member 14 downstream from upstream detecting device 26. If the operating edge path deviates from the second desired edge path, processor 30 initiates the adjustment of upstream detecting device 26 to adjust the first desired edge path to achieve the second desired edge path, thereby optimizing fabric waste.

It should be understood that suitable means for maintaining the second desired edge path, other than those which adjust the first desired edge path, may also be practiced in accordance with the present invention. All such suitable methods and apparatus are within the scope and spirit of the present invention.

In maintaining the second desired edge path, processor 30 repeatedly obtains actual measurements from high speed counter 136. A waiting period between measurements may be desirable, depending upon the operation of the web handling apparatus, to permit the adjustments to the first desired edge path as discussed above to take effect. Applicants anticipate that 5 to 10 seconds would be a generally acceptable range.

Upstream adjustment device 140 may comprise any suitable apparatus for adjusting the first desired edge path. In this preferred embodiment, upstream adjustment device 140 comprises a motor driven adjustable screw, for example an ACME thread screw mounted to frame member 14 or other suitable reference position, such as a decurler base member.

While FIG. 7 includes the use of high speed counter 136, it should be understood that a detecting device 128 might be configured to automatically output a signal corresponding to the total number of gaps detected during the sampling period, thus obviating the need for high speed counter 136. Such a configuration is encompassed by the present invention.

Although the above discussion illustrates a method of automatically adjusting the first desired edge path, upstream detecting device 26 may include means, such as a switch, for deactivating the corrective signals from processor 30 to permit manual adjustment of the first desired edge path required under certain circumstances.

Figure 10:
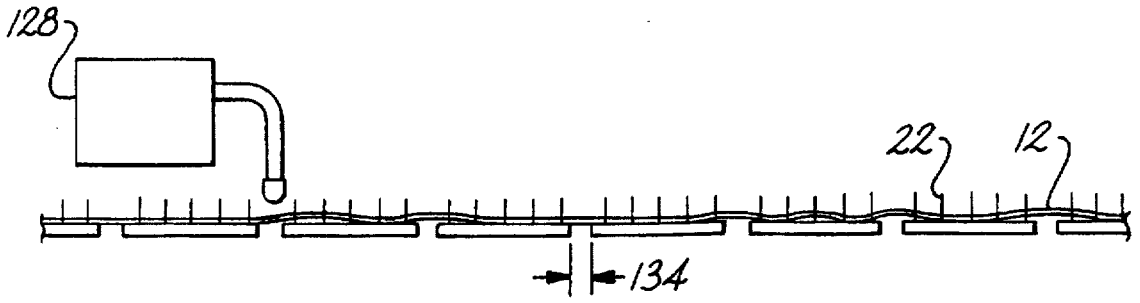
FIG. 10 is a side schematic illustration of the arrangement as in FIG. 8 wherein a fabric is unevenly secured on a tenter frame.

Processor 30 may also be configured to accommodate other abnormalities of longitudinal edge 24 that may affect the accurate detection of deviations of longitudinal edge 24 from the desired operating edge path. For example, certain operations associated with tenter frames, such as drying, cause fabric 12 to shrink. Accordingly, fabric 12 is sometimes fed onto frame member 14 by overfeed roll 122 at a rate faster than that at which endless chain 20 is moving. This causes a bundling of fabric 12 as illustrated in FIG. 10. This bundling permits the shrinkage of fabric 12 downstream without tearing or otherwise damaging the fabric. The ridges in longitudinal edge 24 resulting from this bundling, however, tend to cause false detections by downstream detecting device 128. Because these false detections may occur at a predictable rate, the benchmark measurement may be adjusted accordingly. Thus, for example, the overfeeding of fabric 12 to frame member 14 at some known rate might cause a fifty percent increase in the number of detections in an actual measurement over the number of detections expected if longitudinal edge 24 remained flat and within line 132. Under such conditions, a deviation outward from the second desired path would not be indicated unless the actual measurement was below 150 percent of the original benchmark measurement.

It should be understood that various equivalent configurations of the apparatus according to the present invention are encompassed thereby. For example, various types of apparatus element characteristics, repetitive or continuous, may be sensed by a downstream detecting device to monitor the operating position of a longitudinal edge of a web. Additionally, the detecting device may be configured to output a detection signal either when the characteristic is sensed, as described above, or when it is not. Thus, a detecting device might "search" for the apparatus element characteristic and only output a signal when the characteristic is uncovered. Furthermore, a variety of upstream detecting devices and methods may be utilized to define and adjust the first desired edge path.

Thus, embodiments depicted herein are presented by way of example only and are not intended as limitations upon the present invention. Therefore, while particular embodiments of the invention have been described and shown, it will be understood by those of ordinary skill in this art that the present invention is not limited thereto since many modifications can be made. It is, therefore, contemplated that any and all embodiments are included in the present invention as may fall within the literal or equivalent scope of the appended claims.

What is claimed:

1. A method for maintaining an edge of a moving web at a desired operating path, comprising the steps of:

securing said web by a frame member of a web handling apparatus at a position inward from said web edge;

monitoring, upstream from a longitudinal position with respect to said frame member at which said web is secured by said frame member, the transverse position of said web;

adjusting, responsively to said upstream monitoring, the relative transverse position of said frame member and said web edge;

monitoring, downstream from said longitudinal position, said inward position at which said web is secured by said frame member; and automatically modifying said adjusting of said relative transverse position of said frame member and said web edge so that said frame member secures said web at a desired position proximate said web edge.

2. The method as in claim 1, wherein said downstream monitoring step includes monitoring the transverse position of said web edge.

3. The method as in claim 2, wherein said transverse position of said web edge is monitored by sensing for a characteristic of said web handling apparatus that is distinguishable from said web from a detection position from which said distinguishable characteristic is obscured depending upon the position of said web edge with respect to said desired position.

4. The method as in claim 3, wherein said downstream monitoring step includes comparing occurrences of said characteristic sensed at said sensing step to a number of occurrences of said characteristic expected to be sensed were said edge to remain at least approximately within a predetermined transverse position, thereby indicating the position of said edge with respect to said predetermined transverse position.

5. The method as in claim 4, wherein, in said comparing step, said sensed occurrences are compared to a said expected number Which allows for predictable variations of said web edge within said predetermined transverse position.

6. The method as in claim 4, including determining, prior to said comparing step, said expected number based on a rate at which said characteristic occurs with respect to said detection position.

7. The method as in claim 4, wherein said downstream monitoring step includes counting occurrences of said characteristic prior to said comparing step.

8. The method as in claim 3, wherein said sensing step includes sensing for gaps between spaced apart elements supported by said frame member for securing said web.

9. A web handling apparatus configured to carry a moving web of indeterminate length through a path of travel, said apparatus comprising:

a frame member configured to secure a web at a position inward from a longitudinal edge of said web;

an adjustment device in operative association with one of said frame member and said web and configured to adjust the relative transverse position of said web and said frame member;

a first detection device disposed upstream from a longitudinal position with respect to said frame member at which said web is secured by said frame member, said first detection device configured to monitor the transverse position of said web and to adjust, in association with said adjustment device, said relative position of said web and said frame member; and a second detection device disposed downstream from said longitudinal position, said second detection device configured to monitor said inward position and to adjust, in association with said first detection device, said inward position toward a desired position.

10. The apparatus as in claim 9, wherein said frame member includes an element having a characteristic distinguishable from said web, wherein said second detection device is configured to sense for said characteristic, and wherein said second detection device is disposed relative to said element so that the transverse position of said edge at least in part determines whether said second detection device senses said characteristic.

11. The apparatus as in claim 10, wherein said second detection device comprises a photosensor assembly.

12. The apparatus as in claim 11, wherein said photosensor assembly includes a fiber optic element to permit sensing of said characteristic within a narrowly focused area.

13. The apparatus as in claim 10, wherein said distinguishable characteristic is repetitive, and including a comparing device in operative association with said second detection device and configured to compare a number of said characteristics sensed by said second detection device to a number of occurrences of said characteristic expected to be sensed were said web edge to remain at least approximately within a predetermined transverse position.

14. The apparatus as in claim 13, including a sensor in operative association with said frame member and configured to output a signal to said comparing device relating to the rate of repetition of said repetitive characteristic and wherein said comparing device determines said expected number of occurrences based on said rate.

15. The apparatus as in claim 14, wherein said second detection device is configured to adjust said inward position responsively to a comparison by said comparing device of said sensed number of occurrences to said expected number of occurrences and wherein a said adjustment of said inward position depends upon whether said sensed number is a predetermined level with respect to said expected number.

16. The apparatus as in claim 13, wherein said element defines spaced apart gaps and wherein said second detection device is configured to sense for said gaps.

17. The apparatus as in claim 16, wherein said element comprises a driven endless element supporting plates separated by said gaps and having mechanism thereon for engaging and holding said web proximate said longitudinal edge of said web.

18. The apparatus as in claim 17, wherein said engaging and holding mechanism comprises pins.

19. The apparatus an in claim 13, wherein said second detection device is configured to output signals corresponding to each occurrence of said repetitive characteristic sensed by said second detection device, wherein said comparing device is configured to receive said signals, and wherein said comparing device includes a counting device to count said sensed occurrences responsively to said signals and to output a digital signal corresponding to the number of said repetitive characteristics counted.

20. The apparatus as in claim 9, wherein said first detection device comprises a photosensor assembly configured to detect whether said web edge is present in an area proximate said photosensor assembly and to effect said adjustment of said relative position of said web and said frame member responsively to detection whether said web edge is in said area.

21. The apparatus as in claim 20, including a motive device in operative association with said first detection device and said second detection device, said motive device configured to adjust the transverse position of said photosensor assembly in response to said second detection device to adjust the position of said area in which said photosensor assembly detects whether said web edge is present.

22. The apparatus as in claim 9, wherein, said second detection device monitors said inward position over a predetermined sampling period.

23. The apparatus as in claim 9, wherein said second detection device monitors said inward position by monitoring the transverse position of said web edge.

24. The apparatus as in claim 9, wherein said first detection device is configured to adjust, in association with said adjustment device, said relative position of said web and said frame member in reaction to detection by said first detection device of deviation of said web edge from a normal operating path and at a rate of adjustment dependent upon time said web edge remains out of said normal operating path.

25. A tenter frame for moving a textile web of indeterminate length through a path of travel, said tenter frame comprising:

a frame member having a driven endless element, said driven endless element supporting spaced apart plates having a securing mechanism for securing said textile web at a position inward from a longitudinal edge of said textile web;

an adjustment device in operative association with said frame member and configured to adjust the relative transverse position of said textile web and said frame member;

a first detection device disposed upstream from a longitudinal position with respect to said frame member at which said textile web is secured by said securing mechanism, said first detection device configured to monitor the position of said textile web edge and to adjust, in association with said adjustment device, said relative position of said textile web and said frame member; and a second detection device disposed downstream from said longitudinal position and relative to said plates so that the transverse position of said edge of said textile web at least in part determines whether said second detection device senses one of said plates and gaps between said plates, said second detection device configured to sense for said one of said plates and said gaps, to compare the number of said one of said plates and said gaps sensed by said second detection device to a number of said one of said plates and said gaps expected to be sensed were said textile web edge to remain at least approximately within a predetermined transverse position, and to adjust, in association with said first detection device, said inward position toward a desired position responsively to said comparison of said sensed number to said expected number.

26. A web handling apparatus configured to carry a moving web of indeterminate length through a path of travel, said apparatus comprising:

a frame member including elements to secure a web at a position inward from a longitudinal edge of said web such that a waste area is defined from said edge through said inward position, said elements defining a repetitive characteristic that is distinguishable from said web and that occurs at predictable intervals with respect to a longitudinally stationary position proximate said elements;

an adjustment device in operative association with said frame member and configured to adjust the relative transverse position of said web and said frame member;

a first detection device disposed upstream from a longitudinal position with respect to said frame member at which said securing elements secure said web, said first detection device configured to monitor the transverse position of said web and to adjust, in association with said adjustment device, said relative position of said web and said frame member; and a second detection device downstream from said longitudinal position and configured to sense for said repetitive characteristic, to compare the number of said repetitive characteristics sensed by said second detection device to a number of said repetitive characteristics expected to be sensed were said edge to remain at least approximately within a predetermined transverse position, and to adjust, in association with said first detection device, said inward position to substantially achieve a desired said waste area.

27. The apparatus as in claim 26, wherein said first detection device is configured to adjust, in association with said adjustment device, said relative position of said web and said frame member in reaction to detection by said first detection device of deviation of said web edge from a normal operating path and at a rate of adjustment dependent upon time said web edge remains out of said normal operating path.

28. A web handling apparatus configured to carry a moving web of indeterminate length through a path of travel, said apparatus comprising:

a frame member configured to secure a web at a position inward from a longitudinal edge of said web;

an adjustment device in operative association with one of said frame member and said web and configured to adjust the relative transverse position of said web and said frame member;

a first detection device disposed upstream from a longitudinal position with respect to said frame member at which said web is secured by said frame member, said first detection device configured to monitor the transverse position of said web and to adjust, in association with said adjustment device, said relative position of said web and said frame member; and a second detection device disposed downstream from said longitudinal position, said second detection device configured to monitor the transverse position of said edge and to adjust, in association with said first detection device, said relative position of said web and said frame member to substantially achieve a desired said inward position.

29. A method for maintaining an edge of a moving web at a desired operating path, comprising the steps of:

securing said web on a web handling apparatus having spaced apart elements;

moving said web so that gaps between said spaced apart elements are intermittently obscured with respect to a detection position proximate said spaced apart elements depending upon the position of said edge with respect to a desired edge path;

sensing for one of said gaps and said spaced apart elements with respect to said detection position; and initiating adjustment of said position of said web edge on said web handling apparatus toward said desired operating edge path responsively to whether said one of said gaps and said spaced apart elements is sensed with respect to said detection position.

30. The method as in claim 29, wherein occurrences of said one of said gaps and said spaced apart elements sensed at said sensing step are compared, following said sensing step, to a number of occurrences of said one of said gaps and said spaced apart elements expected to be sensed were said edge to remain at least approximately within said desired edge path.

31. A web handling apparatus configured to carry a moving web of indeterminate length through a path of travel, said apparatus comprising:

a frame member configured to secure a web at a position inward from a longitudinal edge of said web and including spaced apart elements proximate a desired position of said web edge;

a detection device in operative association with said frame member and configured to sense for one of said spaced apart elements and gaps between said spaced apart elements from a detection position situated so that the transverse position of said edge with respect to said desired edge position at least in part determines whether said detection device senses said one of said spaced apart elements and said gaps; and a web adjustment assembly in operative association with said detection device and configured to initiate adjustment of the relative position of said web edge and said frame member responsively to said detection device to achieve said desired position of said web edge.

32. The apparatus as in claim 31, wherein said detection device is disposed on said frame member downstream from a longitudinal position at which said frame member secures said web, wherein said web adjustment assembly includes a detection device disposed upstream from said longitudinal position and configured to monitor the transverse position of said web and to initiate said adjustment responsively to monitoring of said transverse position of said web, and wherein said downstream detection device controls said web adjustment assembly so that said upstream detection device initiates said adjustment so that said web edge at least approximately achieves said desired position.

33. The apparatus as in claim 31, including a comparing device in operative association with said detection device and configured to compare a number of said one of said spaced apart elements and said gaps sensed by said detection device to a number of said one of said spaced apart elements and said gaps expected to be sensed were said edge to remain at least approximately within a predetermined transverse position.

34. A tenter frame for moving a textile web of indeterminate length through a path of travel, said tenter frame comprising:

a frame defining a longitudinal path of travel of said web;

a frame member disposed on said frame generally parallel to said path of travel and pivotally mounted to said frame at a downstream end of said frame member so that said frame member may be adjusted laterally with respect to said path of travel, said frame member having a driven endless element supporting spaced apart plates having a securing mechanism for securing said textile web at a position inward from a longitudinal edge of said textile web during passage of said material at least partially through the tenter frame;

an adjustment device in operative association with said frame member and configured to adjust said frame member laterally with respect to said path of travel;

a first detection device, said detection device including a detector housing disposed on said frame member upstream from said securing mechanism and proximate a normal operating path of travel of said edge, said detector housing including a control detector configured to detect lateral deviation of said edge from said normal operating path and an emergency detector sufficiently laterally offset therefrom to detect substantial lateral deviation of said edge from said normal operating path, said detector assembly being operatively associated with said adjustment device to bring about adjustment of the lateral position of said frame member in reaction to deviation of said edge less than said substantial deviation at a predetermined rate and to bring about adjustment of the lateral position of said frame member in reaction to said substantial deviation at an emergency speed, said emergency speed being greater than said rate of adjustment in reaction to deviation less than said substantial deviation, so that said security elements engage said material at said inward position; and a second detection device disposed on said frame member downstream from said front detection device and relative to said plates so that the transverse position of said edge of said textile web at least in part determines whether said second detection device senses one of said plates and said gaps between said plates, said second detection device configured to sense for said one of said plates and said gaps, to compare the number of said one of said plates and said gaps sensed by said second detection device to a number of said one of said plates and said gaps expected to be sensed were said textile web edge to remain at least approximately within a predetermined transverse position, and to adjust, in association with said first detection device, said inward position toward a desired position responsively to said comparison of said sensed number to said expected number.

* * * * *